US008467565B2

(12) United States Patent
Her et al.

(10) Patent No.: US 8,467,565 B2
(45) Date of Patent: Jun. 18, 2013

(54) INDUCTIVE ELECTROACOUSTIC TRANSDUCER

(75) Inventors: Hong-Ching Her, Taichung (TW); Yu-Lun Lin, Taichung (TW); Wei-Xing Liang, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 110 days.

(21) Appl. No.: 13/240,872

(22) Filed: Sep. 22, 2011

(65) Prior Publication Data

US 2013/0077816 A1 Mar. 28, 2013

(51) Int. Cl.

| | |
|---|---|
| ***H04R 1/00*** | (2006.01) |
| ***H04R 9/06*** | (2006.01) |
| ***H04R 11/02*** | (2006.01) |

(52) U.S. Cl.

USPC ..... 381/412; 381/396

(58) Field of Classification Search

USPC ..... 381/150, 171, 177, 355, 369, 196, 381/400–414; 181/157, 158

See application file for complete search history.

(56) References Cited

U.S. PATENT DOCUMENTS

| | | | | |
|---|---|---|---|---|
| 3,258,543 | A * | 6/1966 | Mosier, Jr. | 381/177 |
| 4,258,234 | A * | 3/1981 | Bordelon et al. | 381/417 |
| 5,748,758 | A * | 5/1998 | Menasco et al. | 381/176 |
| 7,263,199 | B2 * | 8/2007 | Trandafir | 381/409 |

* cited by examiner

*Primary Examiner* — Tuan D Nguyen

(74) *Attorney, Agent, or Firm* — Muncy, Geissler, Olds & Lowe, PLLC

(57) ABSTRACT

An inductive electroacoustic transducer which includes a yoke, a magnetic circuit system disposing in the yoke, a vibration membrane which is driven by the magnetic circuit system, a cover coupled on one side of the yoke and it has a plurality of sound holes, and a circuit board which has a positive pole and a negative pole for importing acoustic electrical signals. The circuit board also has an inductive soldering disc and it is coupled to another side of the yoke. A portion of the yoke is connected to the inductive soldering disc with which it is conducted.

12 Claims, 14 Drawing Sheets

INDUCTIVE ELECTROACOUSTIC TRANSDUCER

BACKGROUND OF THE INVENTION

1. Field of Invention

The present invention relates to an electroacoustic transducer and more particularly to an inductive electroacoustic transducer which employs a yoke to be connectedly conducted to a circuit board which has an inductive function, and be able to form shielding effect for protecting the internal structures of the electroacoustic transducer.

2. Related Art

In the wake of ever-advancing technology, the development of various types of electronic products is becoming more rapid, while electroacoustic transducer is a critical component for sound output of electronic products. With the increasing demand for lighter and slimmer electronic products, the development of slimmer, higher-quality, and micro-sized electroacoustic transducers of low costs is expected to meet the market needs and demands.

Referring to FIG. 1, an electroacoustic transducer 1 of a prior art is shown. One end of the electroacoustic transducer 1 is connected to a circuit board 2. In its circuit design, it only has a positive pole and a negative pole for importing sound signals; however, the effect of protection from static electricity is absent. Therefore, an electroacoustic transducer 3 of a prior art as shown FIG. 2 is developed. A ground terminal 5 is disposed on a cover 4, and the cover 4 and the ground terminal 5 are made of metal, electrically conductive carbon or other electrically conductive materials to be connected to a ground wire of a mobile phone motherboard via the ground terminal 5, in order to ensure that the mobile phone circuit board is protected from static electricity.

Although the abovementioned electroacoustic transducer 3 has the function of protection from static electricity, the resistance of the connection between the ground terminal 5 and the ground wire is rather large which will result in a low sensitivity of induction, besides, the shielding effect is not ideal. Furthermore, a suitable positional arrangement is also needed for the connection between the ground wire of the mobile phone motherboard and the ground terminal 5, or else it will be very inconvenient and troublesome for assembling.

SUMMARY OF THE INVENTION

In view of the abovementioned problems, an object of the present invention is to provide an inductive electroacoustic transducer which employs a yoke connecting to an inductive soldering disc of a circuit board disposed above the yoke in order to be conducted. External devices can be connected to it. Therefore, the protection of the internal structures of the electroacoustic transducer as well as the function of induction is achieved.

In order to achieve the abovementioned objects, the present invention discloses an inductive electroacoustic transducer which comprises a yoke, a magnetic circuit system disposing inside the yoke, a vibration membrane which is driven by the magnetic circuit system, a cover coupled on one side of the yoke and it has a plurality of sound holes, and a circuit board which has a positive pole and a negative pole for importing acoustic electrical signals. The circuit board also has an inductive soldering disc, and the circuit board is coupled to another side of the yoke. A portion of the yoke is connected to the inductive soldering disc with which it is conducted. Accordingly, the inductive soldering disc of the circuit board is connected to an inductive wire, when the inductive wire is grounded, the electroacoustic transducer will also be grounded, so that protection from static electricity is achieved. When the inductive wire is connected to a signal receiver, the electroacoustic transducer can be used as an antenna for sending and receiving frequencies of boardcasting, bluetooth or internet. The electroacoustic transducer can also act as an inductive pole when the inductive wire is connected to a capacitor.

In an embodiment of the present invention, the yoke has a fixing post formed in one piece with the yoke. The inductive soldering disc has a coupling hole for conjunction with the fixing post, so as to have the circuit board fixed on the yoke for connection and conduction, and to be connected to external devices.

In another embodiment of the present invention, the inductive soldering disc has a coupling hole and the yoke has a fixing hole. The circuit board is coupled to one side of the yoke by a metal pin for connection and conduction, and to be connected to external devices.

In yet another embodiment of the present invention, the yoke has an auxiliary foot to be pressed against on the inductive soldering disc, so that the circuit board is clamped and fixed on the yoke for connection and conduction, and to be connected to external devices.

DETAILED DESCRIPTION OF THE INVENTION

An inductive electroacoustic transducer of the present invention will become more fully understood by reference to the following detailed description thereof when read in conjunction with the attached drawings.

Figure 1:
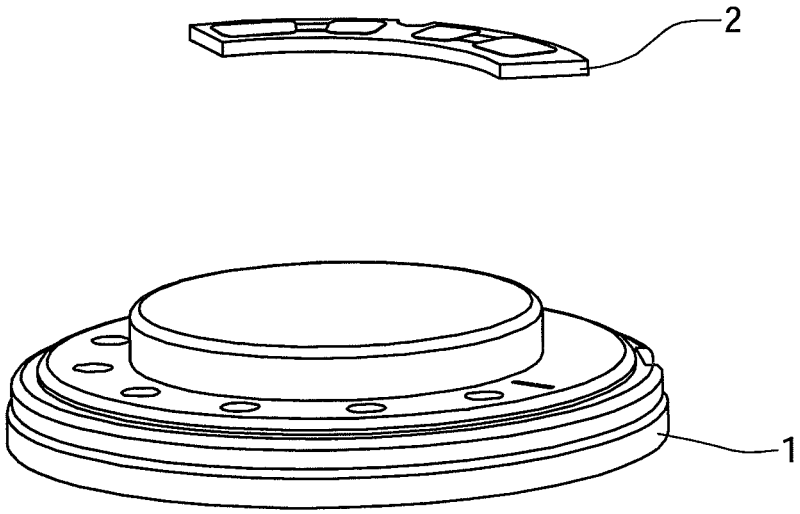
Fig. 1 (Prior Art)
FIG. 1 is an illustration of an electroacoustic transducer of a prior art.
Figure 2:
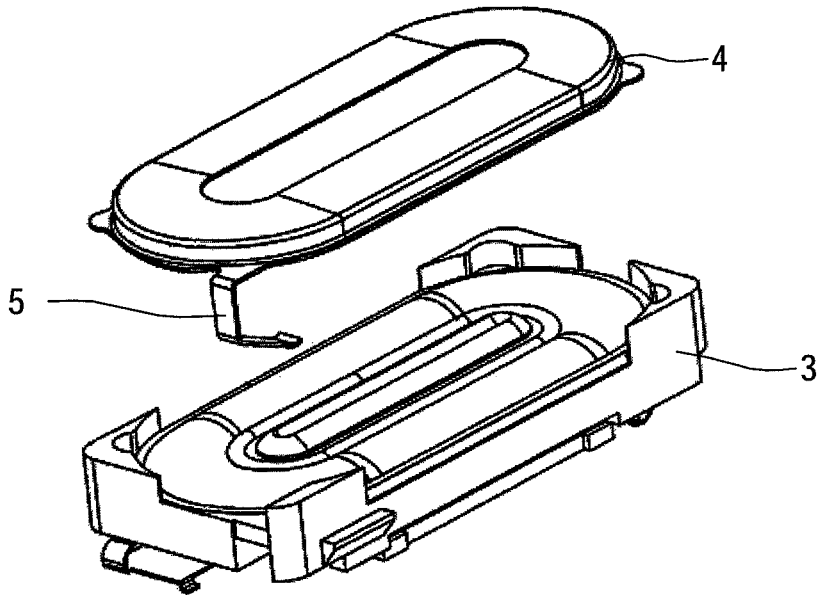
Fig. 2 (Prior Art)
FIG. 2 is an illustration of another electroacoustic transducer of a prior art.
Figure 3:
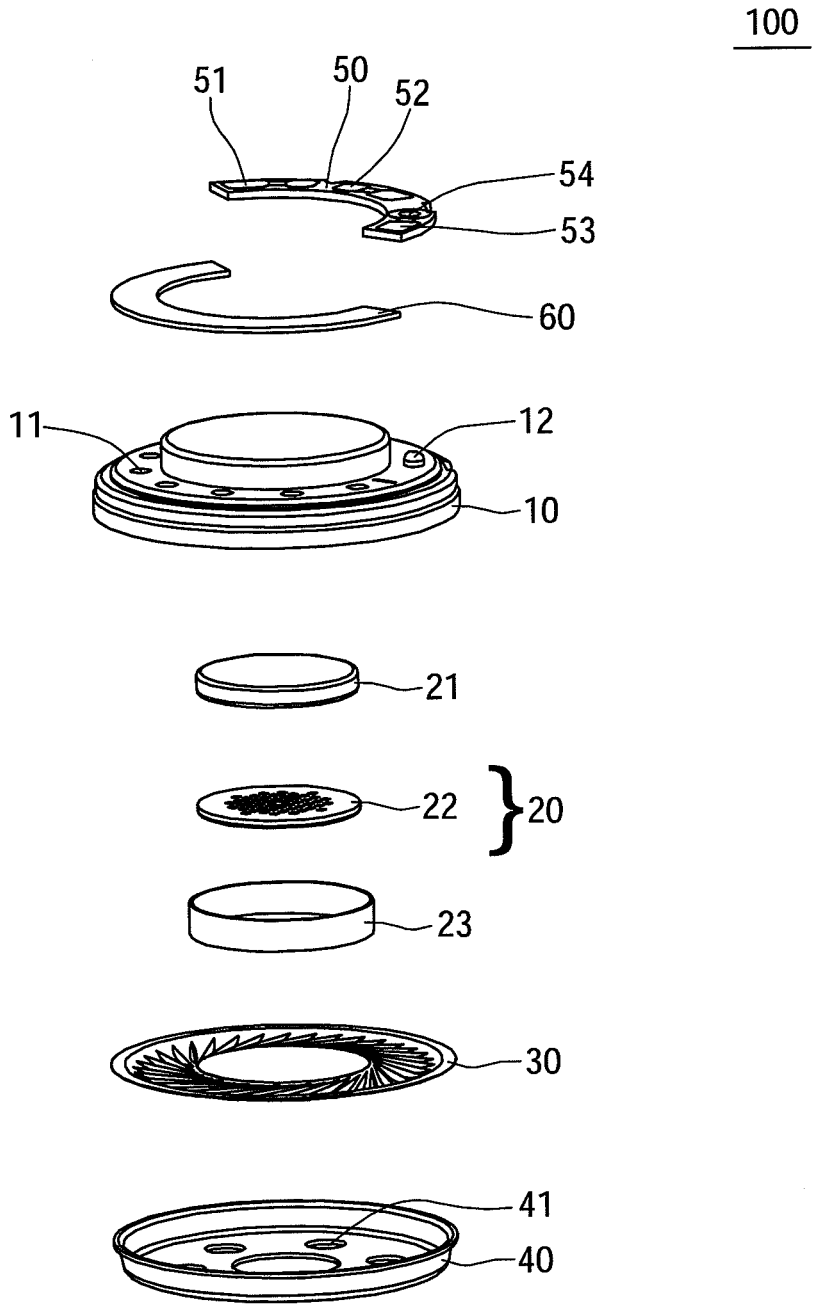
FIG. 3 is a perspective exploded view of an inductive electroacoustic transducer of the present invention.

FIG. 3 shows a perspective exploded view of an inductive electroacoustic transducer of the present invention. An inductive electroacoustic transducer 100 comprises a yoke 10, a magnetic circuit system 20, a vibration membrane 30, a cover 40, a circuit board 50 and a vent piece 60.

The yoke 10 is in a disc shape for accommodating the magnetic circuit system 20 and the vibration membrane 30 of the magnetic circuit system 20. A plurality of vent holes 11 is circumferentially disposed on one side of the base (yoke) 10 so that air inside the disc is connected to the outside. A fixing post 12 is disposed on one end of each of the vent holes 11, and the fixing post 12 is formed in one piece with the yoke 10 which is extended outward from it.

The magnetic circuit system 20 comprises a magnet 21, a magnetic inductive sheet 22 and an acoustic coil 23. One side of the magnet 21 is disposed inside the yoke 10, and the magnetic inductive sheet 22 is disposed on another side of the magnet 21. The acoustic coil 23 is disposed between the magnet 21 and the magnetic inductive sheet 22 on the circumferential edges.

The vibration membrane 30 is coupled to one end of the acoustic coil 23 and is driven by the magnetic circuit system 20.

The cover 40 is made of metal and is coupled to the yoke 10 for covering and retaining the magnetic circuit system 20 and the vibration membrane 30 in the yoke 10. A plurality of sound holes 41 is disposed on the cover 40.

The circuit board 50 has a positive pole 51, a negative pole 52 and an inductive soldering disc 53. The inductive soldering disc 53 has a coupling hole 54 for conjunction with the fixing post 12 of the yoke 10, so that the circuit board 50 is securely disposed on one side of the yoke 10. The positive pole 51 and the negative pole 52 of the circuit board 50 are used for importing acoustic electrical signals.

The vent piece 60 and the circuit board 50 are disposed on a same plane and are attached to one side of the yoke 10 to cover the vent holes 11 for regulating ventilation air amount.

When the acoustic coil 23 is electrically conducted, magnetic field produced by the acoustic coil 23 and the magnetic circuit system 20 will show magnetic attraction and magnetic repulsion effects, so that the acoustic coil 23 will vibrate and produce sound from the vibration of the surrounding air, the sound is then output from the sound holes 41.

Figure 4:
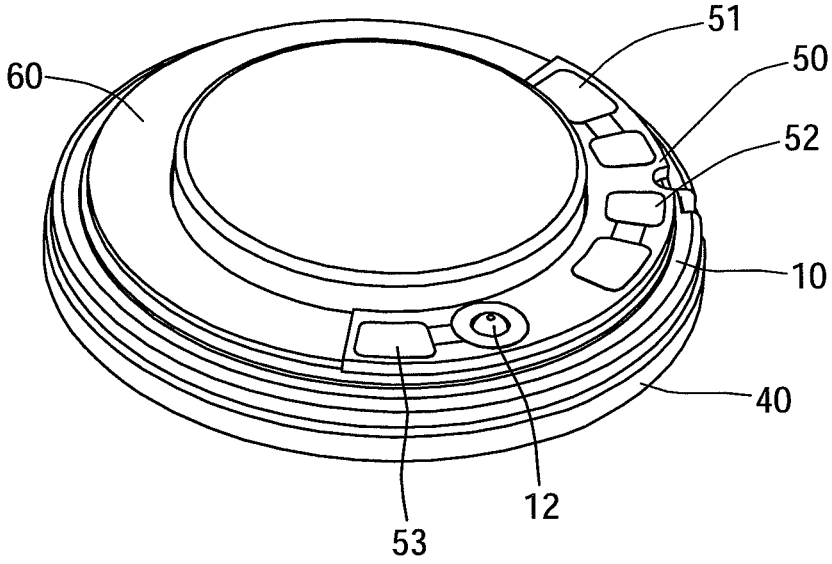
FIG. 4 is a perspective assembly view of an inductive electroacoustic transducer of the present invention.

FIG. 4 shows a perspective assembly view of an inductive electroacoustic transducer of the present invention. The yoke 10 is electrically conducted with the circuit board 50 via the fixing post 12 extended therefrom or by means of soldering, and an inductive wire is connected to the inductive soldering disc 53 of the circuit board 50. When the inductive wire is grounded, the electroacoustic transducer 100 will also be grounded, so as to achieve the protection from static electricity. When the inductive wire is connected to a signal receiver, the electroacoustic transducer 100 can be used as an antenna for sending and receiving frequencies of boardcasting, bluetooth or internet. The electroacoustic transducer 100 can also act as an inductive pole of a capacitor when the inductive wire is connected to the capacitor. The present disclosure employs simple assembling structures to achieve reliable inductive function of the electroacoustic transducer 100 for connection with external devices.

Figure 5:
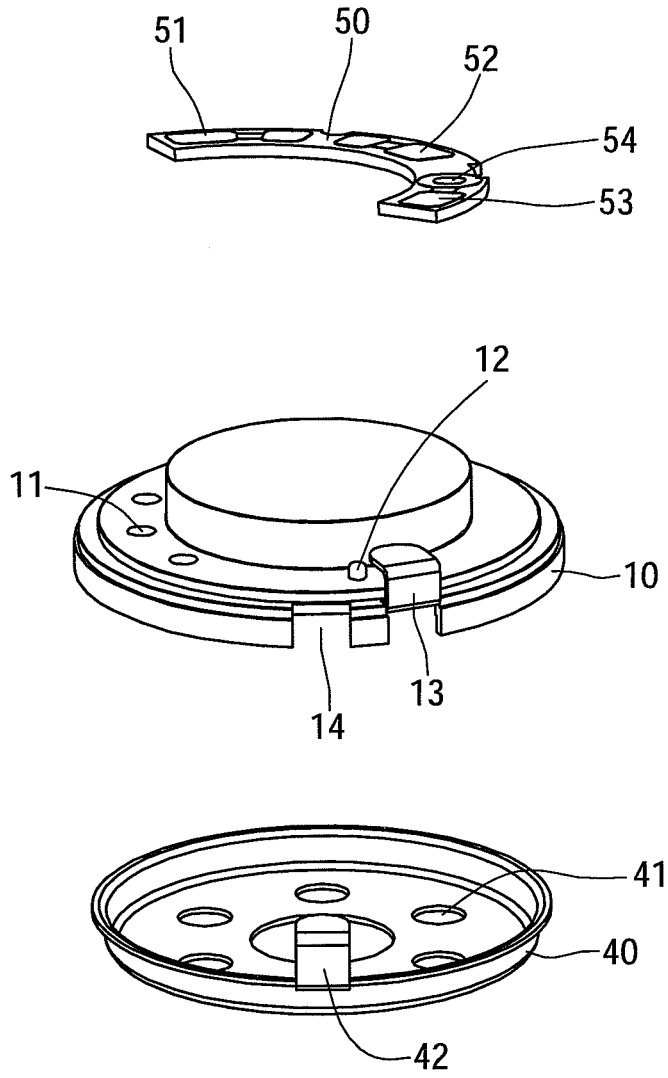
FIG. 5 is a perspective exploded view of a second embodiment of an inductive electroacoustic transducer of the present invention.
Figure 6:
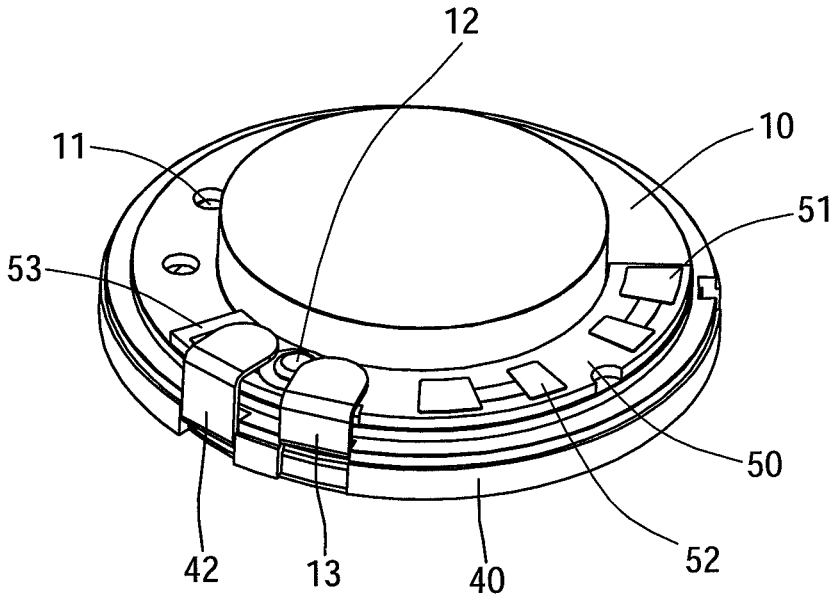
FIG. 6 is a perspective assembly view of a second embodiment of an inductive electroacoustic transducer of the present invention.

FIGS. 5 and 6 show a perspective exploded view and a perspective assembly view of a second embodiment of an inductive electroacoustic transducer of the present invention respectively. In the embodiment, in order to simply the drawings, the vent holes 30, the magnetic circuit system 20 and the vibration membrane 30 mentioned above are not disclosed. The differences between this embodiment and the previous lies in that: an upside-down L shaped foot 42 is protruded from the cover 40, and the yoke 10 has an upside-down L shaped auxiliary foot 13 formed by bending its circumferential edge; an indentation 14 is disposed by one side of the auxiliary foot 13, so that when the cover 40 is coupled with the yoke 10, the foot 42 can pass through the indentation 14 to be pressed against the inductive soldering disc 53 of the circuit board 50 on the yoke 10, in order to be electrically conducted; the auxiliary foot 13 is also pressed against the inductive soldering disc 53 so that the cover 40 and the yoke 10 are electrically conducted with the inductive soldering disc 53 simultaneously; they can also be soldered together to enhance the reliability so that the overall protection from static electricity and shielding effects are achieved. In this embodiment, the auxiliary foot 13 can be omitted according to requirements. Even without the auxiliary foot 13, the cover 40 and the yoke 10 can still be electrically conducted with the circuit board 50.

Figure 7:
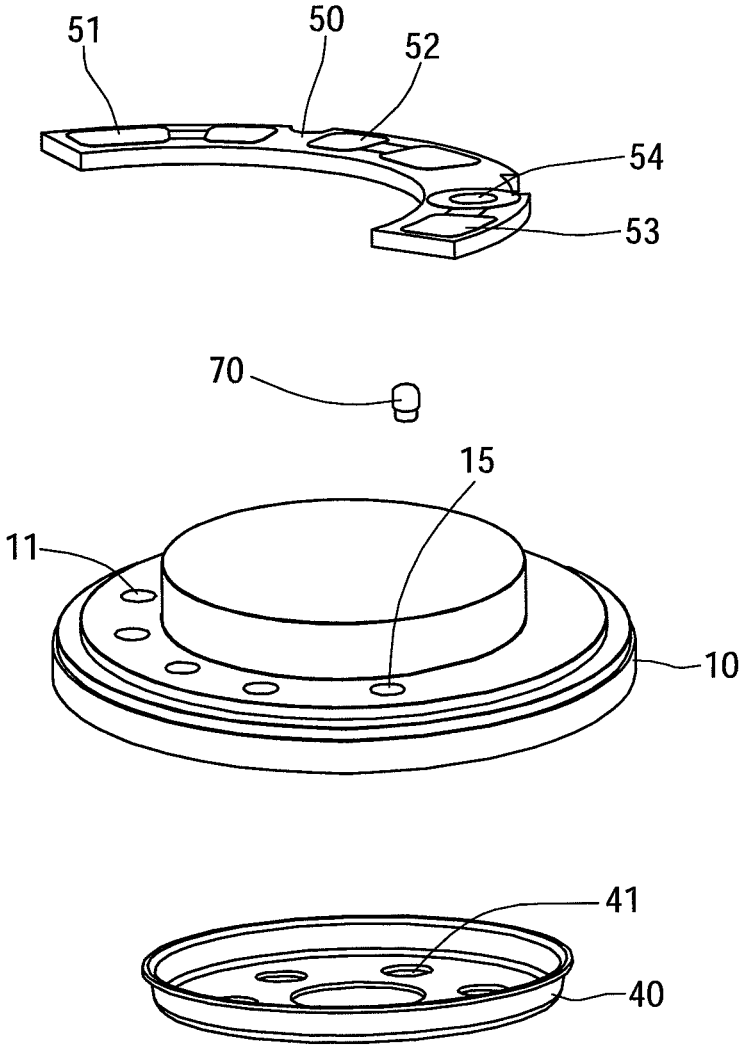
FIG. 7 is a perspective exploded view of a third embodiment of an inductive electroacoustic transducer of the present invention.
Figure 8:
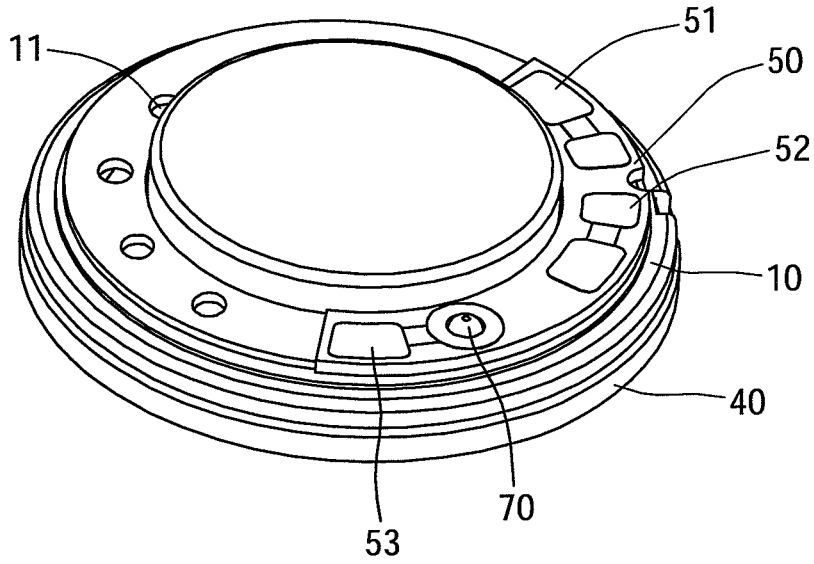
FIG. 8 is a perspective assembly view of a third embodiment of an inductive electroacoustic transducer of the present invention.

FIGS. 7 and 8 show a perspective exploded view and a perspective assembly view of a third embodiment of an inductive electroacoustic transducer of the present invention respectively. The differences between this embodiment and the previous ones lies in that: the yoke 10 has a fixing hole 15, a metal pin 70 passes through the coupling hole 54 of the circuit board 50 and the fixing hole 15 of the yoke 10, so that the yoke 10 is fixed on the circuit board 50 and therefore the yoke 10 is electrically conducted with the circuit board 50; the yoke 10 can then be connected to external devices via an inductive wire.

Figure 9:
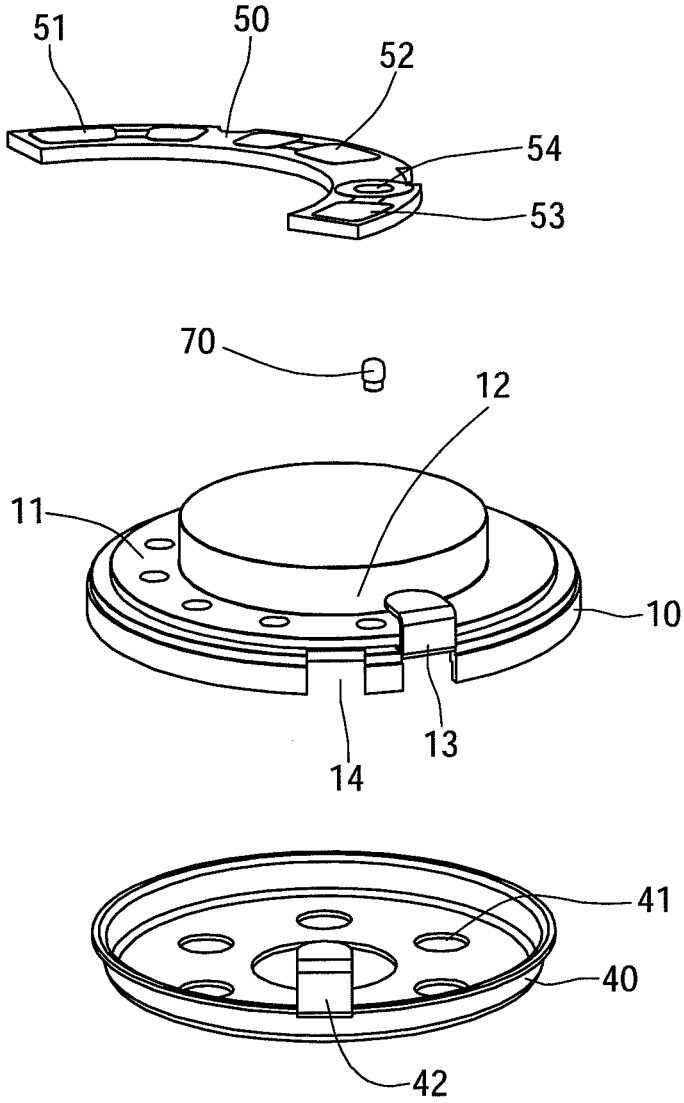
FIG. 9 is a perspective exploded view of a fourth embodiment of an inductive electroacoustic transducer of the present invention.
Figure 10:
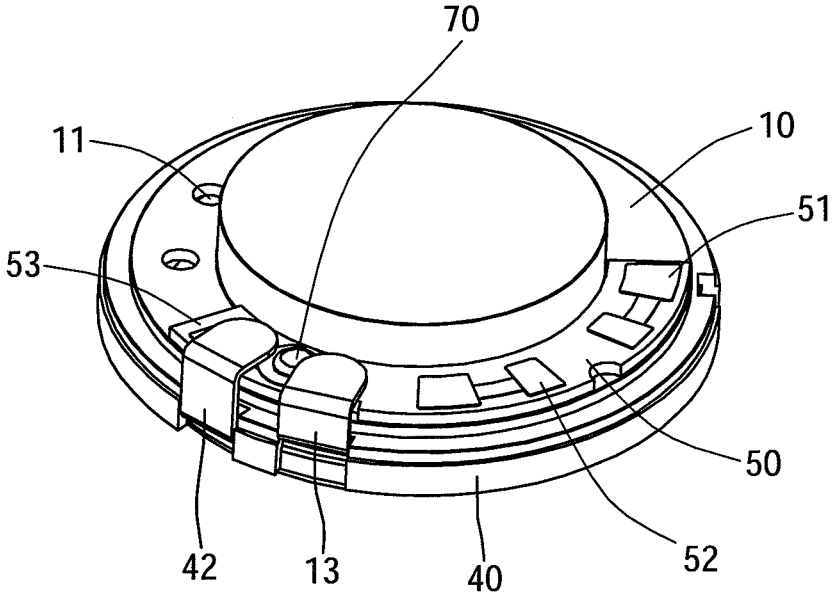
FIG. 10 is a perspective assembly view of a fourth embodiment of an inductive electroacoustic transducer of the present invention.

FIGS. 9 and 10 show a perspective exploded view and a perspective assembly view of a fourth embodiment of an inductive electroacoustic transducer of the present invention respectively. The differences between this embodiment and the third embodiment lies in that: the yoke 10 and the foot 42 of the cover 40 are pressed against the inductive soldering disc 53 of the circuit board 50 and are securely fixed on it by soldering to ensure the reliability. In this embodiment, the auxiliary foot 13 can be omitted if the pin 70 is made of conductive materials, and the conduction effect of the cover 40, the yoke 10 and the circuit board 50 will still remain.

Figure 11:
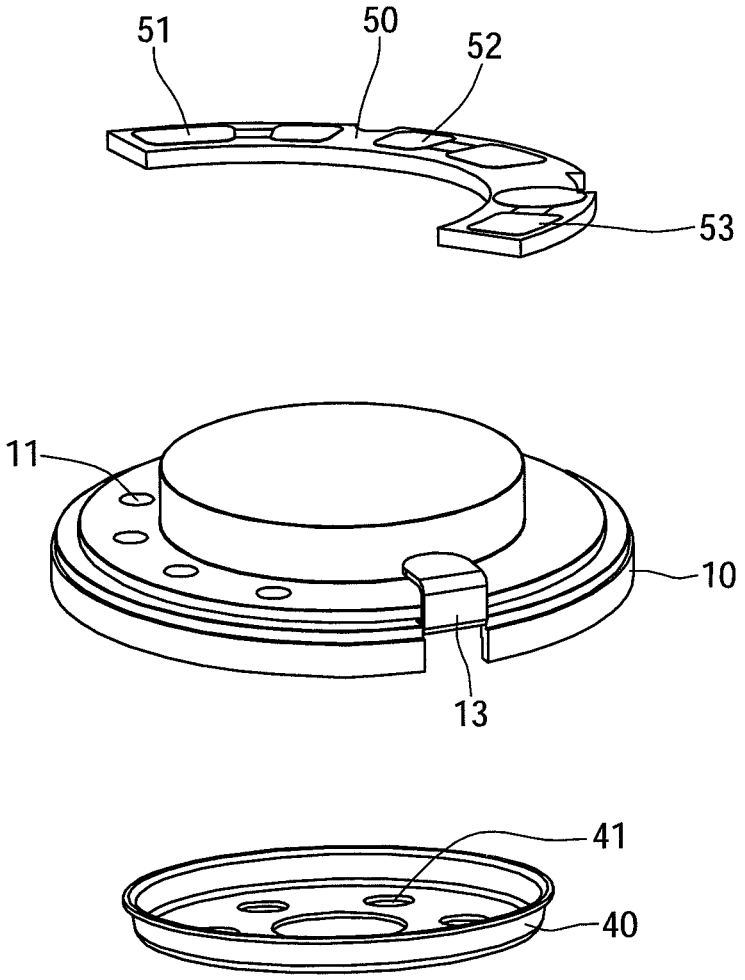
FIG. 11 is a perspective exploded view of a fifth embodiment of an inductive electroacoustic transducer of the present invention.
Figure 12:
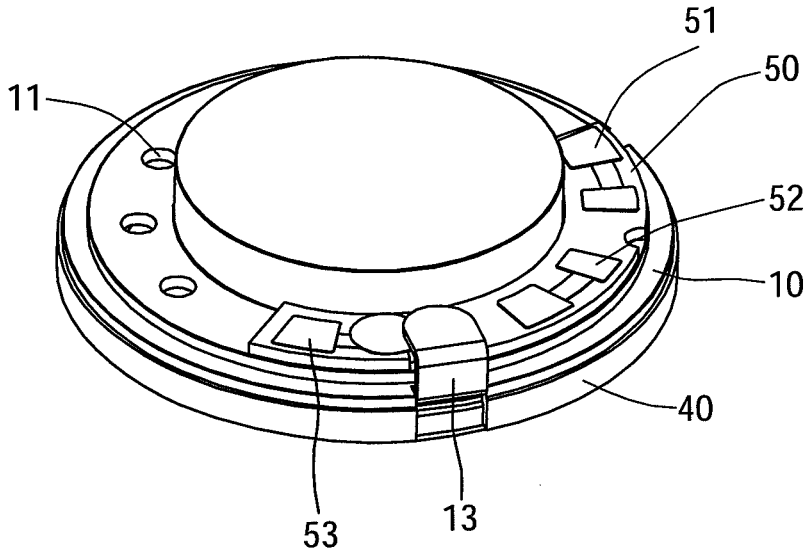
FIG. 12 is a perspective assembly view of a fifth embodiment of an inductive electroacoustic transducer of the present invention.

FIGS. 11 and 12 show a perspective exploded view and a perspective assembly view of a fifth embodiment of an inductive electroacoustic transducer of the present invention respectively. In the embodiment, the auxiliary foot 13 of the yoke 10 is mainly used for fixing the circuit board 50, so that the circuit board 50 is held and fixed on one side of the yoke 10; and the auxiliary foot 13 is pressed against the inductive soldering disc 53 of the circuit board 50 to be electrically conducted, the yoke 10 can then be connected to external devices via an inductive wire.

Figure 13:
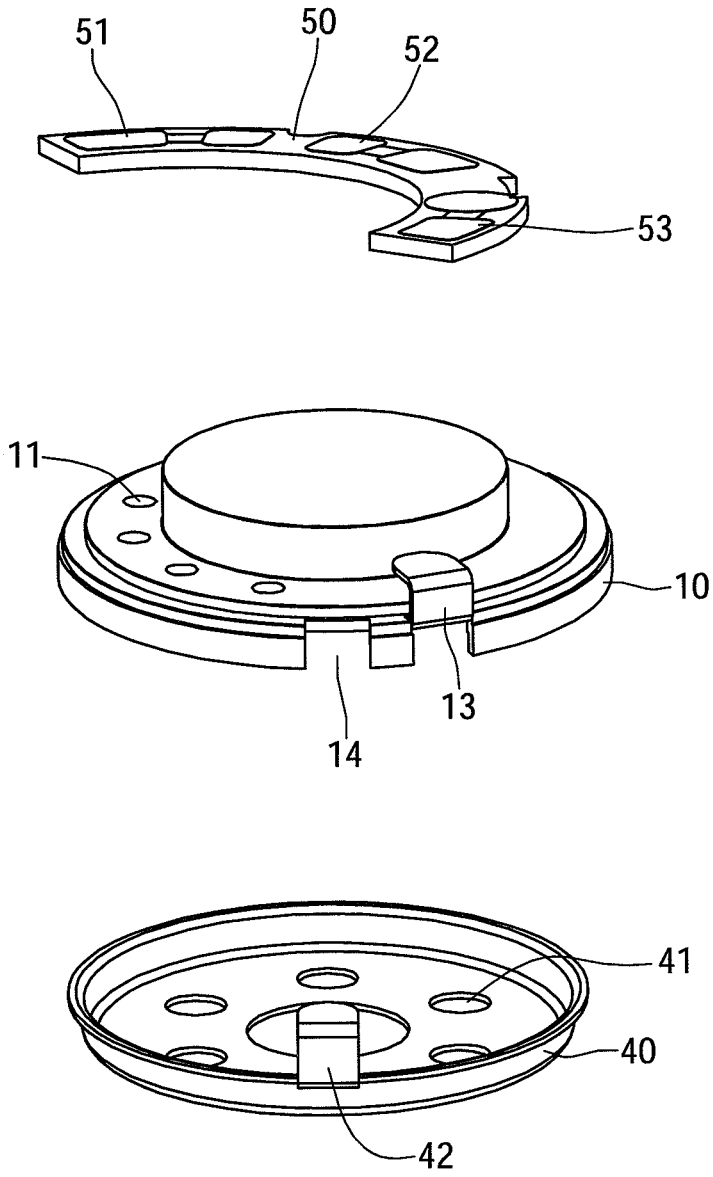
FIG. 13 is a perspective exploded view of a sixth embodiment of an inductive electroacoustic transducer of the present invention.
Figure 14:
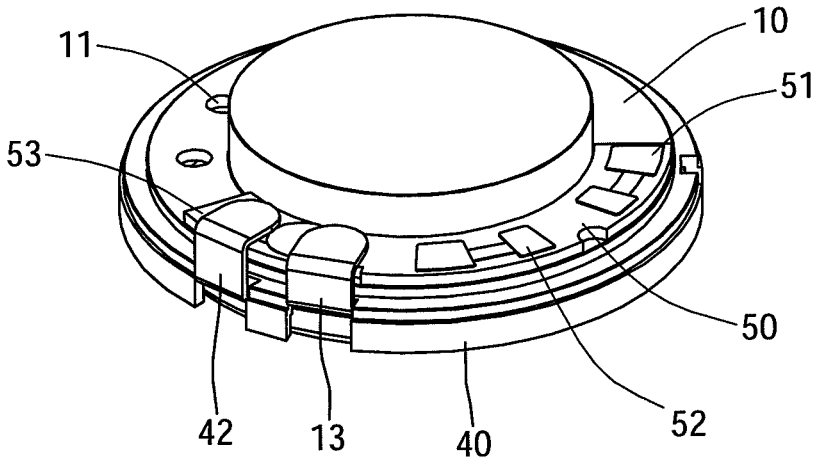
FIG. 14 is a perspective assembly view of a sixth embodiment of an inductive electroacoustic transducer of the present invention.

FIGS. 13 and 14 show a perspective exploded view and a perspective assembly view of a sixth embodiment of an inductive electroacoustic transducer of the present invention respectively. The differences between this embodiment and the fifth embodiment lies in that: the cover having the foot 42, the foot 42 of the cover 40 and the auxiliary foot 13 of the yoke 10 are pressed against the inductive soldering disc 53 of the circuit board 50 to be conducted; so that the cover 40, the yoke 10 and the circuit board 50 are all conducted, so as to have an overall shielding effect, and the yoke 10 can then be connected to external devices via an inductive wire.

To summarize the abovementioned inductive electroacoustic transducer of the present invention, it employs a yoke with a fixing post to be coupled to a coupling hole of an inductive soldering disc, so as to fix a circuit board on the yoke; or a metal pin is used to couple the circuit board on one side of the yoke through the coupling hole of the inductive soldering disc and a fixing hole of the yoke; or an auxiliary foot is disposed on the yoke to be directly pressed against the inductive soldering disc in order to securely hold the circuit board on the yoke. The circuit board can be fixed on the yoke by any one of the previous means, and therefore the yoke is connectedly conducted with the inductive soldering disc of the circuit board, and is able to connect to external devices when the inductive soldering disc is connected with an inductive wire. When the inductive wire is grounded, the electroacoustic transducer will also be grounded, so that protection from static electricity is achieved. When the inductive wire is connected to a signal receiver, the electroacoustic transducer can be used as an antenna for sending and receiving frequencies of boardcasting, bluetooth or internet. The electroacoustic transducer can also act as an inductive pole of a capacity when the inductive wire is connected to the capacitor.

In the previously mentioned embodiments of the present invention, a foot can be disposed on a cover, or a foot and an auxiliary foot can be disposed on a cover and a yoke respectively at the same time; for securely fixing a circuit board on the yoke and to be connectedly conducted with an inductive soldering disc of the circuit board. Therefore, an overall shielding effect for the inductive electroacoustic transducer is achieved, the internal components are protected, and specific inductive function is also achieved.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. An inductive electroacoustic transducer, comprising:

a yoke;

a magnetic circuit system disposed inside said yoke;

a vibration membrane driven by said magnetic circuit system;

a cover coupled to one side of said yoke and having a plurality of sound holes; and a circuit board having a positive pole and a negative pole for importing acoustic electrical signals, said circuit board also having an inductive soldering disc and said circuit board being coupled to another side of said yoke, a portion of said yoke is coupled to said inductive soldering disc with which it is conducted.

2. The inductive electroacoustic transducer as claimed in claim 1, wherein said yoke has a fixing post formed in one piece, said inductive soldering disc having a coupling hole for conjunction with said fixing post in order to be conducted.

3. The inductive electroacoustic transducer as claimed in claim 2, wherein said cover is made of a metal and said cover has a foot to be electrically connected to said inductive soldering disc.

4. The inductive electroacoustic transducer as claimed in claim 3, wherein said yoke has an auxiliary foot to be electrically connected to said inductive soldering disc.

5. The inductive electroacoustic transducer as claimed in claim 4, wherein said yoke has an indentation disposed by a side of said auxiliary foot for said foot of said cover to pass through.

6. The inductive electroacoustic transducer as claimed in claim 1, wherein said inductive soldering disc has a coupling hole and said yoke has a fixing hole, a metal pin is used to couple said circuit board on one side of said yoke in order to be conducted.

7. The inductive electroacoustic transducer as claimed in claim 6, wherein said cover is made of a metal and said cover has a foot to be electrically connected to said inductive soldering disc.

8. The inductive electroacoustic transducer as claimed in claim 7, wherein said yoke has an auxiliary foot to be electrically connected to said inductive soldering disc.

9. The inductive electroacoustic transducer as claimed in claim 8, wherein said yoke has an indentation disposed by a side of said auxiliary foot for said foot of said cover to pass through.

10. The inductive electroacoustic transducer as claimed in claim 1, wherein said yoke has an auxiliary foot to be pressed against said inductive soldering disc in order to be conducted, and said circuit board is held and fixed by said auxiliary foot.

11. The inductive electroacoustic transducer as claimed in claim 10, wherein said cover is made of a metal and said cover has a foot to be electrically connected to said inductive soldering disc.

12. The inductive electroacoustic transducer as claimed in claim 11, wherein an indentation is disposed by a side of said auxiliary foot for said foot to pass through.

* * * * *